United States Patent [19]

Marass

[11] Patent Number: 5,076,564

[45] Date of Patent: Dec. 31, 1991

[54] SHEET FEEDER

[75] Inventor: Josef Marass, Murnau, Fed. Rep. of Germany

[73] Assignee: George Spiess GmbH, Gersthofen, Fed. Rep. of Germany

[21] Appl. No.: 671,953

[22] Filed: Mar. 19, 1991

[30] Foreign Application Priority Data

Apr. 11, 1990 [DE] Fed. Rep. of Germany ..... 4011663

[51] Int. Cl.[5] ..... B65H 5/14

[52] U.S. Cl. ..... 271/11; 271/96; 271/108

[58] Field of Search ..... 271/90, 96, 98, 104, 271/108, 11

[56] References Cited

U.S. PATENT DOCUMENTS

| | | | |
|---|---|---|---|
| 1,418,145 | 5/1922 | Fischer | 271/108 |
| 1,625,239 | 4/1927 | Broadmeyer | 271/96 |
| 1,706,952 | 3/1929 | Broadmeyer | 271/96 |
| 1,747,809 | 2/1930 | Aldrich | 271/96 |
| 1,774,315 | 8/1930 | Broadmeyer | 271/96 |
| 2,874,962 | 2/1959 | Layden | 271/96 |
| 3,866,764 | 2/1975 | Leiser | 271/104 |
| 3,999,795 | 12/1976 | Barker | 271/108 |
| 4,081,945 | 4/1978 | Calvert et al. | 271/108 |
| 4,090,702 | 5/1978 | Wirz | 271/96 |
| 4,175,676 | 11/1979 | Renaud et al. | 271/108 |
| 4,327,906 | 5/1982 | Fröhlich et al. | 271/90 |
| 5,037,080 | 8/1991 | Wirz | 271/98 |

FOREIGN PATENT DOCUMENTS

| | | | |
|---|---|---|---|
| 1239326 | 6/1965 | Fed. Rep. of Germany | 271/105 |
| 2313514 | 3/1973 | Fed. Rep. of Germany | 271/90 |
| 98442 | 6/1982 | Japan | 271/96 |

*Primary Examiner*—Robert P. Olszewski
*Assistant Examiner*—Steven M. Reiss
*Attorney, Agent, or Firm*—Edwin D. Schindler

[57] ABSTRACT

In the case of a sheet feeder comprising a suction head which is arranged over a rising table for a stack of sheets and bears at least one sucker able to be connected with a source of vacuum and with air synchronously in steps with the operation of the equipment, a cam predetermined such steps and, following the suction head, a sheet conveyor, it is possible to achieve a more precise operation and more gentle handling of the products by providing an air supply duct and a vacuum duct, which are associated with the at least one sucker provided, and alternately switched on and off by a switching valve arranged near the sucker. For its part, the valve is operated by a control valve, actuated by the cam.

10 Claims, 2 Drawing Sheets

SHEET FEEDER

BACKGROUND OF THE INVENTION

The invention relates to a sheet feeder comprising a suction head which is arranged over a rising table for a stack of sheets and bears at least one sucker able to be connected with a source of vacuum and with air synchronously in steps with the operation of the equipment, a cam predetermining such steps and, following the suction head, sheet conveying means.

In the case of conventional sheet feeders of this type the connection of the suckers with the vacuum and the supply of air thereto is timed by valves arranged in the suction head. These valves are generally in the form of plate or rotary piston valves which have a large flow orifice. Apart from design complexity in conjunction with the incorporation of such valves in the suction head, there is the further disadvantage that owing to the orifice section and the large number of bends there will be substantial reductions in the flow rate and in pressure. More particularly, there is the disadvantage however that the vacuum paths between the vacuum source and the means operated thereby, that is to say between the sucker and the valve arranged in the suction head are very long. The establishment and release of the vacuum should take place as smartly as possible in this case, since long ducts have to be emptied and filled with air. The consequence of this is that a completely regular sheet transfer to the further parts of the conveying system in the form of intermittently operated rolls synchronized with the sheets, or similar conveying means, is practically not possible. In fact there is the danger that even on transfer from the said conveying means the sheet will be gripped before it has been released by the suckers and vice versa. A further difficulty which necessarily occurs is that the point in time of the arrival of the sheets at the front guides of a following machine processing the products will vary, this being likely to interfere with proper operation of the plant. Furthermore, rough handling of the sheets will be likely.

SHORT SUMMARY OF THE PRESENT INVENTION

Accordingly one object of the invention is to provide a sheet feeder of the type initially mentioned which is so improved by the additional of simple and low-price means that highly exact operation becomes possible.

In accordance with a further aim of the invention this is to be achieved in such a manner that as to avoid damage to the products.

In order to achieve these and/or purposes, in the invention an air supply duct and a vacuum duct, which are associated with the at least one sucker provided, are able to be alternately switched on and off by means of a switching valve arranged near and preferably in the sucker, and for its part the valve is able to be operated by a control valve able to be actuated by the cam.

Owing to the arrangement, which is at least near the sucker and is preferably inside the sucker, of the switching valve there is the particular advantage of extremely short paths between the switching valve and the associated means operated by the vacuum or air supply and accordingly very small volumes which have to be filled with air and exhausted. It is therefore possible to expect the advantage of a brisk and prompt supply of air to and removal of air from the sucker. Accordingly it is possible to achieve the advantage of highly regular, controllable timing of the sheet transfer and consequently as well of the arrival of the sheets at the front stops of the machine following the sheet feeder for processing the products. In this case it is particularly advantageous that there is the no damage to the sheets and no irregular operation of the equipment.

Advantageous further developments and expedient features of the invention are described in the claims. Thus as an example, the sucker may conveniently be provided with an upper part through which there extends an air supply duct running from a hole (which constitutes one section of the vacuum duct) and from which the air supply duct (which leads to an air supply opening) extends, and in the upper part the switching valve, which is in the form of a two-way valve, is placed. These features lead to a particularly compact and mechanically simple design with extremely short paths for the supply and removal of air.

In accordance with a further possible development of the invention the switching valve may comprise a slide or spool with a groove, and which is arranged in a valve bore or hole, which intersects the through hole constituting one section of the vacuum duct and the air supply duct extending from it. This means that simple reciprocating movement of the spool may be used to effect the desired operation of the compressed air or, respectively, air supply duct. The fact that the spool may be moved rapidly and practically without any lag with a comparatively small force leads to the useful advantage of highly exact timing.

A further possible feature of the invention is such that the hole for the spool is connected at one end at least with a fluid power medium duct and preferably a compressed air duct, which by means of the control valve may be switched on and off, that is to say have air supplied to it or to be exhausted. The use of a medium under pressure, preferably in the form of compressed air, for the operation of the spool leads to a very sturdy arrangement which is not liable to failure but is nevertheless simple in structure. In this case the spool may be arranged to be acted upon by the pressure medium at both ends alternatingly; or in accordance with a convenient feature of the invention it may be simply moved by a return spring in one direction, this leading to a particularly simple structure.

In keeping with yet another particularly simple form of the invention it is possible for the pressure medium duct to branch downstream from the control valve into a number of branches corresponding to the number of associated suckers. This means that it is possible to use one control valve to serve a plurality of suckers with one integrated switching valve. In this respect it may be a question of all suckers of the suction head or preferably at any rate a question of all drag suckers.

The invention will now be described in more detail with reference to the accompanying drawings, which show one working embodiment thereof.

LIST OF THE SEVERAL VIEWS OF THE FIGURES

DETAILED ACCOUNT OF WORKING EMBODIMENT OF THE INVENTION

Figure 1:
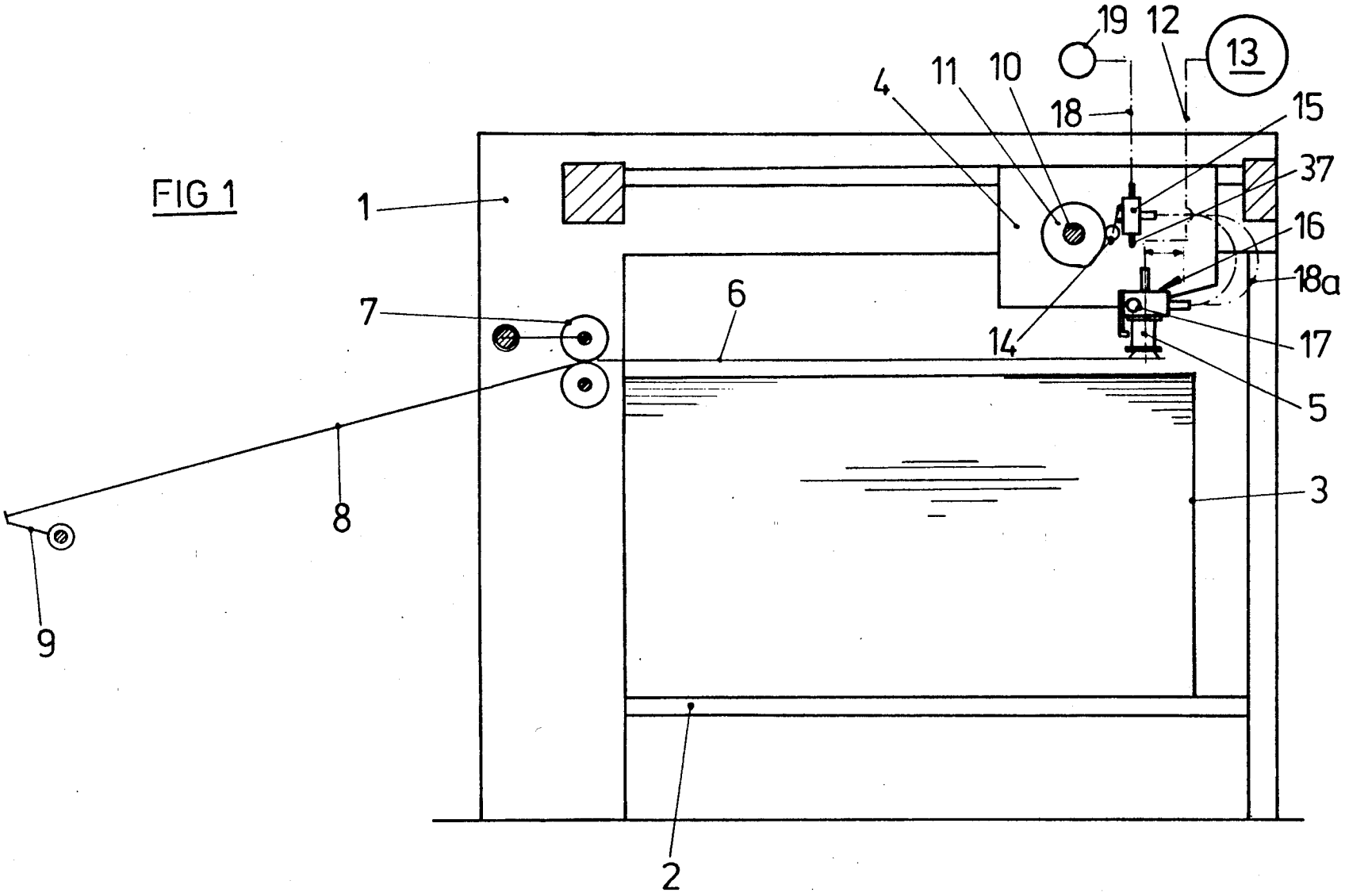
FIG. 1 is a diagrammatic side elevation of a sheet feeder in accordance with the invention.

The sheet feeder illustrated in FIG. 1 comprises a gantry-like frame 1, in which a rising table 2 is mounted in order to receive a stack 3 of sheets and is able to be moved upwards and downwards. At the top of the frame 1 there is an adjustable suction head 4, which extends over the stack 3 of sheets and which may be set to the rear edge of the stack. The suction head 4 is provided with suckers 5, of which merely one is illustrated in order to simplify the drawing.

Normally the suction head 4 will have one set of vertically moving suckers and one set of dragging or horizontally moving suckers. The vertically moving suckers in this case have the function of lifting the respectively uppermost sheet 6 from the stack 3 of sheets. The dragging suckers have the function of receiving the respectively lifted sheet 6 and forwarding it to such an extent that it may come into engagement with conveying means 7, which are arranged at the front part of the frame 1 and in the present case are in the form of intermittently operated rolls synchronized with the sheets. This arrangement is adjoined by a feed board 8 which in practice is in the form of a table with conveyor tapes or belts, which ends at the front stops 9, against which the leading edges of the sheets abut before they are drawn into the processing machine. In order to attain trouble-free operation it is necessary for the individual sheets to be properly and exactly timed as regards their arrival at the stops 9. For this purpose it is necessary to avoid any slip, more particularly on the conveying means 7, when the sheets are transferred.

The suction head 4 contains a disk cam 11 able to be driven by a drive shaft 10 connected with a single turn shaft, such cam controlling the operation of the suckers 5 and of the other moving parts of the suction head 4. The suckers 5 are connected via a respectively associated vacuum duct 12 with a source 13 of vacuum, as for instance one in the form of a pre-existing vacuum duct system on the premises and they are synchronously connected and disconnected from it and have air supplied to them. In order to time these functions there is a control valve 15, which is arranged in the suction head 4 and is provided with a follower 14 in engagement with a cam 11, by which the a switching valve 16 positioned near to the sucker may be operated and placed in the vacuum duct 12. This switching valve 16 is in the present case designed in the form of a two-way valve by which the vacuum duct may be interrupted and an air supply port 17 may be opened and vice versa.

In order to transmit the control pulses from the control valve 15 to the switching valve 16 there is a control duct 18, which is connected with a source of powder and has the control valve 15 placed in it. In the illustrated working embodiment this duct 18 is in the form of a pressure medium duct connected with a source 19 of medium under pressure, for instance one in the form of the already installed compressed air supply system in the premises, and downstream from the control valve 15 it is possible for the control duct 18 to be divided as a number of branches **18*a* equal to the number of associated suckers, such branches respectively leading to an associated switching valve 16. Therefore it is possible to use one control valve 15 to time or operate a plurality of control valves, as for instance valves 16 associated with one respective sucker 5. For each type of sucker, that is to say for the lifting suckers and for the dragging suckers it is possible to have one associated control valve. However it would be quite possible to associate an individual control valve with each sucker and, respectively, each switching valve. Furthermore it would be possible for an individual switching valve 16 to be associated with each sucker or each group of suckers. In the illustrated working embodiment one switching valve 16 is to be associated with each sucker 5 in which it is integrated, this being best shown in FIGS. 2 and 3**.

Figure 2:
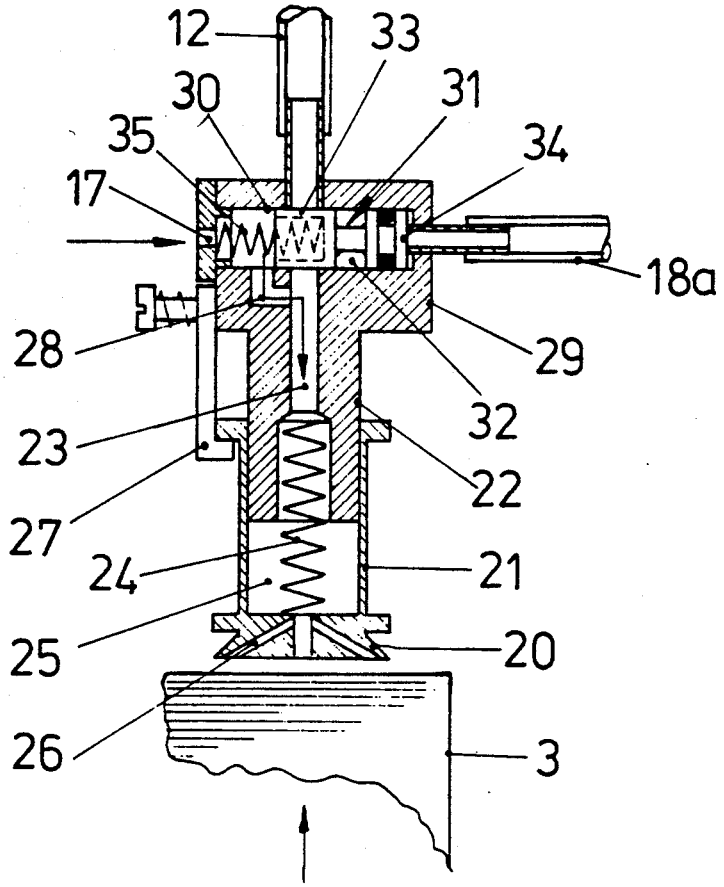
FIG. 2 is a view on a larger scale of a sucker in the position supplied with air.
Figure 3:
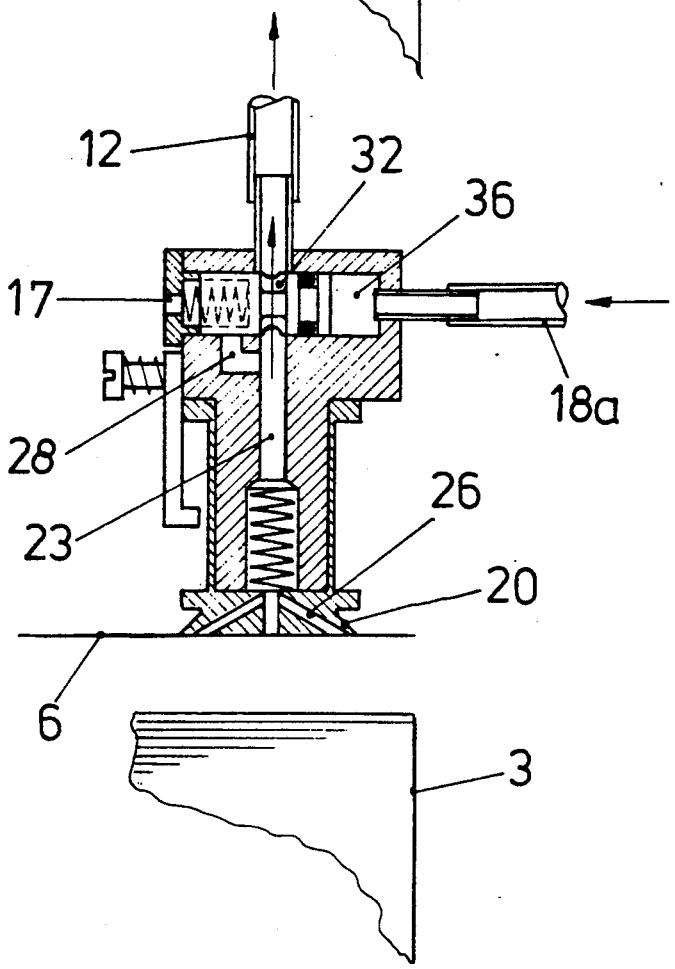
FIG. 3 shows the said sucker in the exhausted condition.

In the case of the sucker 5 of the present embodiment of the invention it is a question of a so-called jump sucker, which as illustrated in FIGS. 2 and 3, consists of a suction plate 20 on which a rear cuff 21 is mounted and of an upper part which is secured to a support bar (secured to the suction head) or the like and comprises a pin 22 surround by the cuff 21, such pin 22 having a coaxial hole 23 extending through it and opening via a connection pipe into the vacuum duct 12 and accordingly constituting the suction end thereof. The suction plate 20 is supported by means of a spring 24 on the pin 22 and it may be lifted clear of it with the formation of an expansion space 25 which at the periphery is delimited by the cuff 21 and into which the through duct 23 opens and from which the suction holes 26 of the suction plate 20 extend. The size of this stroke of the lower part of the sucker is predetermined by an stationary abutment 27 cooperating with a collar on the cuff 21.

A branch 28 extends from the through duct 23 and leads to the air supply opening 17 and it may be opened and, respectively, switched off by means of a switching valve, which is installed in the upper part of the sucker, alternatively to the through duct 23, which constitutes a part of the vacuum duct. For this purpose the housing block 29, which bears the pin 22, of the upper part of the sucker is provided with a valve hole 30 (which extends perpendicularly to the through duct 23 and parallel to branch 28) which in the present case runs coaxially to the air supply opening 17, and this valve hole or bore 30 receives a valve spool 31, which is able to be moved between the terminal positions illustrated in FIGS. 2 and 3. This spool 31 possesses two pistons 33 and, respectively, 34 which are separate from each other by an annular circumferential groove 32.

In the illustrated working embodiment the spool 31 is pushed by an associated setting spring 35 into its air supply position illustrated in FIG. 2 in which the through duct 23 (which constitutes a part of the vacuum duct 12) is interrupted by the piston 33 and the branch 28 leading to the air supply opening 17 is no longer turned off. The spool 31 is moved by the pressure medium, which is controlled by the control valve 15, in the opposite direction. For this purpose the associated branch **18*a* of the control duct is connected with the valve bore 30 on the side which is opposite to the spring 35. When the pressure acts the spool 31 moves into the terminal position illustrated in FIG. 3, the size of the pressure space 36 being increased, and in the terminal position the piston 30 shuts off the branch 28 leading to the air supply opening 17 and the annular groove 32 uncovers a flow path from the through duct 23 to the vacuum duct 12**.

The sealing edges of the spool 31 and the distance apart between the through duct 32 and the branch, parallel to the same, of the branch 28 are so matched in relation to each other that the above mentioned positions of switching may be attained. Accordingly the distance of the said branch of the branch 28 from the end, opposite to the air supply opening 17, of the valve duct 30 is equal to at least the length of the spool 31 so that in the terminal position, remote from the air supply opening 17, of the spool 31 the air supply path as indicated by the arrows in FIG. 2 is produced. Owing to the arrangement in the sucker of the air supply opening 17 this path is very short. The distance of the through duct 23 from the air supply end of the valve duct or bore 30 is equal to at least the length of the piston 33 on the air supply side 33 so that in the terminal position illustrated in FIG. 3 the annular groove 32 is in alignment with the through duct 23 and for this reason frees the flow path as indicated by the arrows in FIG. 3. The clearance width of the annular groove 32 may be equal to the diameter of the through duct 23.

As already noted, the pressure medium for the displacement of the spool 32 it is possible to use compressed air from the compressed air lines or main of the premises in which the sheet feeder is installed, such compressed air being controlled by the control valve 15, since the control duct 18, which is in the form of a compressed air duct, is opened and, respectively, shut off and downstream from the obstruction is supplied with air. In order to effect this supply of air the control valve 15 may simple be designed in the form of a two-way valve provided with a venting outlet 37. However it would also be possible for the spool 31 to be driven electromagnetically. In this case the control duct may be in the form of a power cable and the control in the form of a switching relay.

The vacuum duct 12 is permanently kept under vacuum. And similarly medium under pressure is always present at the control valve 15. Therefore, as soon as following suitable operation of the control valve 15 the spool 31 is acted upon, the latter will move into the position illustrated in FIG. 3, in which the bore 23 is separated from the air supply opening 17 and is connected with the vacuum duct 12 so that there is a suction effect at the suction plate 20 or, respectively, its ducts 26, such suction effect drawing up the respectively uppermost sheet 6 and thus decreasing the size of the expansion space 25. The volume of air present on opening the passage from the duct 23 to the vacuum duct 12 underneath the spool 21 is comparatively small so that the said suction effect is brisk or abrupt. Then as soon as the action of the pressure on the spool 31 ceases the spools 31 will return in this case under the action of the spring into the terminal position illustrated in FIG. 2, in which the through duct 23 is separated from the vacuum duct 12 and is connected with the air supply opening 17. The duct volume underneath the spool 31 which is to be filled with air is also very small so that the air supplying or venting action occurs very briskly. Owing to the said air supply the sheet which was previously held against the suction plate 20, is released and simultaneously it is possible for the lower part of the sucker to be moved out under the action of the spring 24 so that the next sheet will be aspirated the next time the vacuum acts.

I claim:

1. A sheet feeder comprising: a movable suction head, for moving a sheet to a sheet conveying means, which is arranged over a rising table for a stack of sheets and has at least one sucker connected to both a source of vacuum, through a vacuum duct, and to the atmosphere through an air supply duct, in synchronism with the movement of the suction head; a cam predetermining such synchronism and; wherein the vacuum duct is alternately switched open and closed by a switching valve arranged near the sucker, and the switching valve is actuated by a source of flow of pressurized medium, which, itself, is actuated by a control valve, actuated by the cam.

2. The sheet feeder as claimed in claim 1, wherein the switching valve is mounted on, and inside, its associated sucker.

3. The sheet feeder as claimed in claim 1, wherein the sucker has an upper part through which a through duct which opens into the vacuum duct extends, and from which the air supply duct also extends, and the switching valve, which is in the form of a two-way valve, is incorporated in the upper part.

4. The sheet feeder as claimed in claim 1, wherein the switching valve has a spool with an annular groove, the spool is arranged in a valve bore, the valve bore intersects both the through duct connected with the vacuum duct and the air supply duct, which also extends from the vacuum duct.

5. The sheet feeder as claimed in claim 4, wherein adjacent to one end surface the valve bore with the spool therein is connected to a pressure medium duct which constitutes a control duct when either, supplied with pressurized medium, or not, and by means of the control valve.

6. The sheet feeder as claimed in claim 4, comprising a return spring adapted to move the spool into a switching position.

7. The sheet feeder as claimed in claim 5, wherein the control valve is constituted by a two-way valve provided with a venting opening.

8. The sheet feeder as claimed in claim 1, wherein downstream from the control valve the control duct is divided up into a plurality of branches, whose number is preferably equal to the number of the associated suckers.

9. The sheet feeder as claimed in claim 1, also having at least one drag sucker, and wherein a switching valve is also provided for at least each drag sucker.

10. The sheet feeder as claimed in claim 1, wherein a switching valve is associated with each sucker.

* * * * *